US010871123B2

(12) United States Patent
Feichtinger et al.

(10) Patent No.: US 10,871,123 B2
(45) Date of Patent: Dec. 22, 2020

(54) CYLINDER HOUSING OF AN INTERNAL COMBUSTION ENGINE

(71) Applicant: AVL LIST GMBH, Graz (AT)

(72) Inventors: Stefan Feichtinger, Büchl/Weiz (AT); Stefan Stocker-Reicher, St. Michael I. Obersteiermark (AT); Günter Häusl, Wundschuh (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 16/485,666

(22) PCT Filed: Feb. 14, 2018

(86) PCT No.: PCT/AT2018/060042
§ 371 (c)(1),
(2) Date: Aug. 13, 2019

(87) PCT Pub. No.: WO2018/148773
PCT Pub. Date: Aug. 23, 2018

(65) Prior Publication Data

US 2020/0003148 A1 Jan. 2, 2020

(30) Foreign Application Priority Data

Feb. 14, 2017 (AT) ..... 50123/2017

(51) Int. Cl.
*F02F 1/16* (2006.01)
*F02F 1/10* (2006.01)
*F02F 7/00* (2006.01)

(52) U.S. Cl.
CPC ..... *F02F 1/16* (2013.01); *F02F 1/10* (2013.01); *F02F 7/0007* (2013.01); *F02F 2001/106* (2013.01)

(58) Field of Classification Search
CPC ..... F02F 1/16; F02F 1/10; F02F 2001/106; F02F 7/00; F02F 7/0095; F02F 1/004; F02F 7/0046; F01P 3/02
See application file for complete search history.

(56) References Cited

U.S. PATENT DOCUMENTS 6,283,081 B1 * 9/2001 Ozeki ..... F02F 1/108 123/193.2
2008/0245320 A1 * 10/2008 Ishikawa ..... F02F 1/108 123/41.74
2018/0106210 A1 * 4/2018 Hunter ..... F02B 75/28

FOREIGN PATENT DOCUMENTS

DE 1751787 A1 2/1972
EP 2738377 A1 11/2013
JP S5493605 U 7/1979
JP S5731549 U 2/1982
(Continued)

*Primary Examiner* — Long T Tran
(74) *Attorney, Agent, or Firm* — Dykema Gossett PLLC

(57) ABSTRACT

Aspects of the present disclosure are directed to a cylinder housing of an internal combustion engine. In one embodiment of the present disclosure, the cylinder housing includes at least two adjacently arranged cylinders, each of which includes a wet cylinder liner, a support structure, and a coolant jacket arranged between the support structure and the cylinder liner. The cylinder housing further including at least one screw receptacle for a cylinder head screw, and is positioned between at least two adjacently arranged cylinders in a region of at least one engine transverse plane.

19 Claims, 1 Drawing Sheet

(56) References Cited

FOREIGN PATENT DOCUMENTS

| | | | |
|---|---|---|---|
| JP | H0411241 | U | 1/1992 |
| JP | 2011163215 | A | 8/2011 |

* cited by examiner

CYLINDER HOUSING OF AN INTERNAL COMBUSTION ENGINE

CROSS-REFERENCE TO RELATED APPLICATIONS

This application is a national stage filing based upon International PCT Application No. PCT/AT2018/060042, filed 14 Feb. 2018, which claims the benefit of priority to Austria application No. A 50123/2017, filed 14 Feb. 2017.

BACKGROUND

The invention relates to a cylinder housing of an internal combustion engine having at least two adjacently arranged cylinders, each of which comprises a wet cylinder liner which is received by a support structure, wherein a coolant jacket is arranged between the support structure and the cylinder liner, having a closed deck forming a cylinder head sealing surface, wherein at least one screw receptacle for a cylinder head screw is arranged in the region of an engine transverse plane between two cylinders.

In cast cylinder housings with wet cylinder liners, the cylinder liners on their outer jacket are flushed with coolant. A cast cylinder housing with wet cylinder liner, for example, is known from DE 10 2012 111 521 A1. The support structures of the cylinder housing of two adjacent cylinders in the area of the transverse plane of the engine, which accommodate the cylinder liners, are usually connected to each other. This results in mechanical and thermal disadvantages.

A cast cylinder housing is known from JP 2011-163215 A, which has screw receptacles for the cylinder head screws arranged relatively deep in the cylinder housing. The screw receptacles are positioned in a central area of the cylinder and spaced from the upper deck.

SUMMARY OF THE INVENTION

It is the object of the invention to propose a cylinder housing that allows optimum cooling and reduces the mechanical stress on the cylinder housing.

According to the invention, this object is solved in a cylinder housing of the type mentioned at the beginning in that the support structures of two adjacent cylinders are free from each other at the intersecting region of the engine transverse plane with an engine longitudinal plane containing the cylinder axes. This reduces deformation of the cylinder liner.

The invention results in an advantageous force distribution in an integral, e.g. cast, cylinder housing.

In an advantageous manner, in the region of at least one engine transverse plane between two cylinders, a main bearing wall formed integrally with the cylinder housing is arranged.

Advantageously, the minimum distance between two adjacent support structures in the area of the coolant jacket corresponds to at least half the cylinder head screw diameter, preferably at least the cylinder head screw diameter. This enables substantial thermal and mechanical decoupling of two adjacent cylinders from each other.

For further mechanical decoupling, it can also be provided that at least one screw receptacle is spaced from the deck. At least one screw receptacle is located in a central region of the cylinder in the embodiment variant of the invention, wherein the screw receptacle preferably adjoins two adjacent support structures at the side. This enables the cylinder head screws to be largely decoupled from the support structure.

The support structure in the area of the coolant jacket is mainly hollow-cylindrical in shape, wherein particularly good cooling of areas subject to high thermal stress can be achieved if the coolant jacket is formed between a cylindrical inner wall of the support structure and a cylindrical outer wall of the cylinder liner, preferably in the upper third of the cylinder liner.

An advantageous embodiment of the invention provides that the support structure, in a region adjoining the coolant jacket in the direction of the crank chamber, preferably in the region of the screw receptacle, has a conically shaped transition region, wherein the conically shaped transition region tapers in the direction of the deck. It is particularly advantageous if at least two adjacent support structures in the area of the base of the conically shaped transition regions are connected to each other via an intermediate deck. Preferably the intermediate deck is connected to a main bearing wall. This results in an advantageous introduction of force from the first screw receptacle into the main bearing wall and a stable mechanical support of the cylinder housing.

It is particularly advantageous if the support structure, in a region formed between the cylinder head sealing surface and the screw receptacle, is subjected to compressive forces in the installed condition during operation of the internal combustion engine and the remaining region of the support structure and the main bearing walls is subjected to tensile forces. This enables substantial mechanical and thermal decoupling of the cylinders from each other on the one hand and from the cylinder head screws on the other hand. Deformation of the cylinder liner is also reduced.

BRIEF DESCRIPTION OF THE DRAWINGS

The invention is explained in more detail below using a non-restrictive example shown in the figures, wherein.

DETAILED DESCRIPTION

Figure 1:
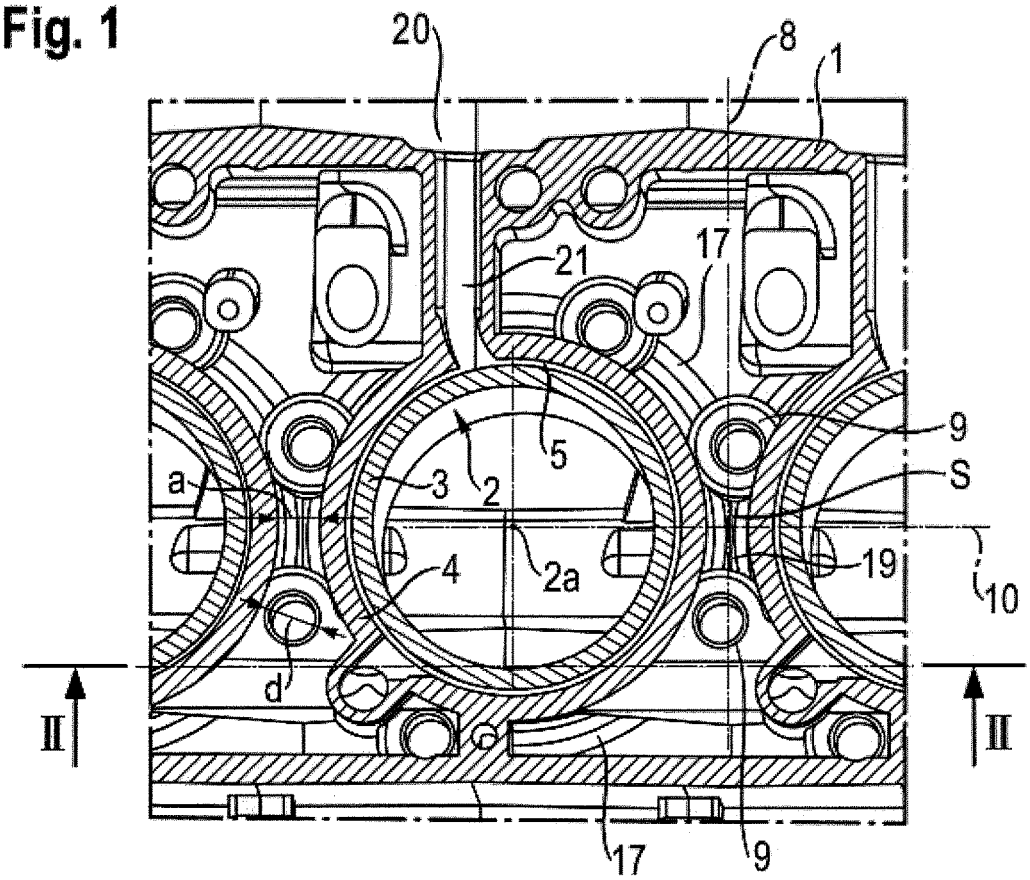
FIG. 1 shows a cylinder housing according to the invention in a section according to line I-I in FIG. 2.

The cylinder housing 1 of an internal combustion engine is designed for several adjacently arranged cylinders 2 having a wet cylinder liner 3, which are each accommodated by a support structure 4 of the cylinder housing 1. The cylinder housing 1 is designed integrally and assumes both the function of supporting the cylinder liners 3 and a crankshaft which is not shown further. To support the crankshaft, the cylinder housing 1 has integrated main bearing walls 18 in the area of engine transverse planes 8. The main bearing walls 18 can be designed exactly in the respective engine transverse plane 8 or slightly offset relative to said plane. In addition, a housing apron of cylinder housing 1 that is co-manufactured in one piece—for example in a casting process or an additive process, for example a 3D printing process—defines a crankcase 16 to accommodate the crankshaft.

Crankcases including the crankcase apron and main bearing walls 18 of the internal combustion engine are designed in one piece with the cylinder housing 1.

A coolant jacket 5 is arranged between the support structure 4 and the cylinder liner 3. On both sides of the coolant jacket 5, the cylinder liner 3 rests close to the sealing faces 4*a*, 4*b* of the support structure 4, wherein gaskets are designated with the reference numeral 11. The support structures 4 are essentially hollow-cylindrical in the area of the coolant jacket 5. The coolant casing 5, which is fed by the coolant channel 20 via the transition channel 21, extends in the radial direction between a cylindrical inner wall 13 of the support structure 4 and a cylindrical outer wall 14 of the cylinder liner 3 and is arranged in the upper third 15 of the cylinder 2. The upper third 15 here is that third of cylinder 2 which faces the cylinder head sealing surface 6. The transition channel 21 flows into the coolant jacket 5 in an arc, whereby the coolant quantity is distributed in a predefined manner via the cylindrical coolant jacket 5. This enables a uniform cooling of the cylinder 2.

On the upper side of the cylinder housing 1 facing the cylinder head which is not shown further, it has a closed deck 7 forming a cylinder head sealing surface 6. In the region of an engine transverse plane 8, between two cylinders 2, two screw receptacles 9 for a cylinder head screw not shown further are arranged at a distance from deck 7. In the embodiment example, the distance b of the screw receptacle 9 from deck 7 corresponds to about half the cylinder diameter D of cylinder 2. The screw receptacles 9 can be formed exactly in the respective engine transverse plane 8 or slightly offset to it.

The support structures 4 of two adjacent cylinders 2 are free from each other in the section region S of the engine transverse plane 8 by an engine longitudinal plane 10 containing the cylinder axes 2*a*, wherein the minimum distance a of two adjacent support structures 4 in the area of the coolant jacket 5 in the embodiment example corresponds approximately to the cylinder head screw diameter d.

Figure 2:
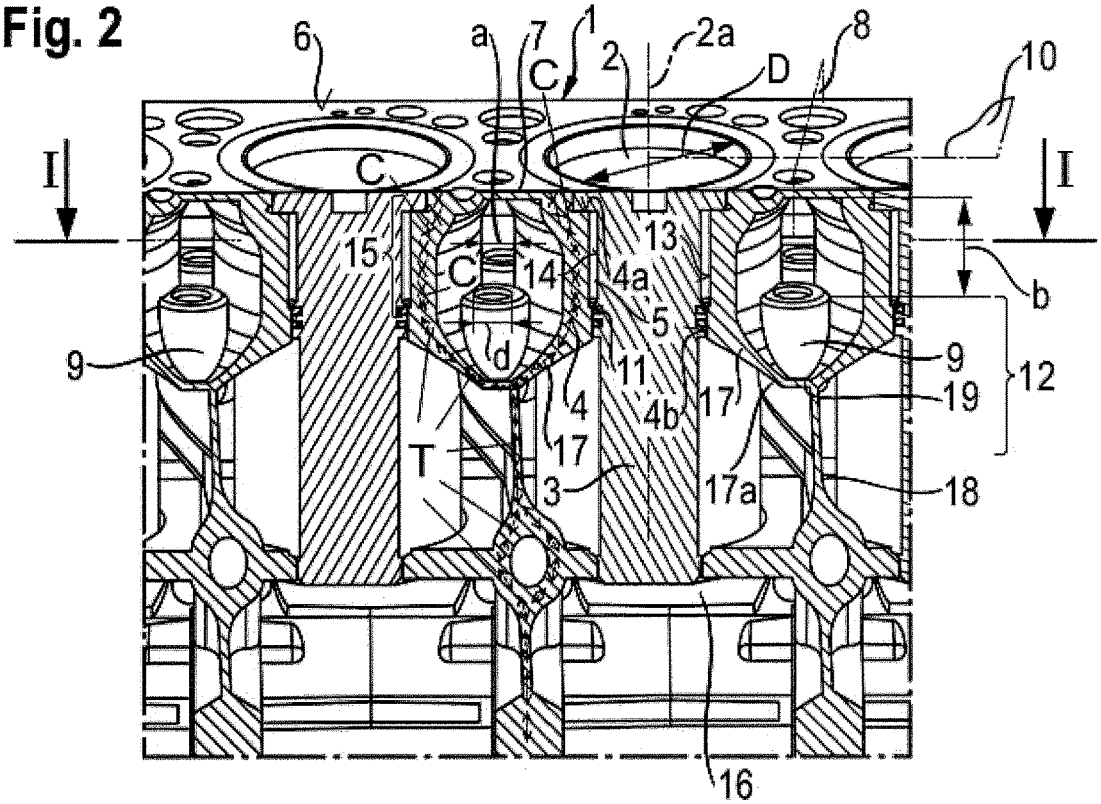
FIG. 2 shows the cylinder housing in an oblique view in a section according to line II-II in FIG. 1.

The screw receptacles 9 are located in a middle third 12 of the cylinder 2. Each screw receptacle 9 laterally adjoins two adjacent support structures 4. The support structures 4 have conically shaped transition regions 17 in regions adjacent to the coolant jacket 5 in the direction of the crank chamber 16—especially in the area of the screw receptacles 9. The conically shaped transition regions 17 taper towards deck 7. In the area of base 17*a* of the conically shaped transition regions 17, adjacent support structures 4 are interconnected via an intermediate deck 19. Main bearing walls 18 adjoin the transition regions 17 towards the crank chamber 16. This arrangement forms an advantageous force control with compressive forces C and tensile forces T in the cylinder housing 1, as indicated in FIG. 2. During operation of the internal combustion engine, pressure forces C act on the support structure 4 of the cylinder housing 1 above the screw receptacle 9—in the embodiment example shown, in the upper third 15 of cylinder 2. The remaining region of the support structure 4, in the embodiment example shown in the middle third 12 of the cylinder and below, as well as the main bearing walls 18 of the cylinder housing 1 are subjected to tensile forces T.

The fact that the support structures 4 are spaced apart from each other in the region of the engine longitudinal plane 10 and the screw receptacles 9 are spaced apart from deck 7, results in extensive mechanical and thermal decoupling of the cylinder 2 from each other on the one hand and from the cylinder head screws on the other hand. Deformation of the cylinder liner 3 is also reduced.

The invention claimed is:

1. Cylinder housing of an internal combustion engine, the cylinder housing comprising:

at least two adjacently arranged cylinders, each of which includes a wet cylinder liner, a support structure which receives the wet cylinder liner, and a coolant jacket is arranged between the support structure and the wet cylinder liner, the coolant jacket including a closed deck forming a cylinder head sealing surface;

at least one screw receptacle, configured and arranged to receive a cylinder head screw, and is positioned between the at least two adjacently arranged cylinders in a region of at least one engine transverse plane; and wherein the support structures are free from each other in an intersection region of the at least one engine transverse plane, with an engine longitudinal plane containing a cylinder axes;

wherein the support structure, in a region adjoining the coolant jacket in a direction of a crankcase, has a conically shaped transition region, and wherein the conically shaped transition region tapers in the direction of the closed deck.

2. Cylinder housing according to claim 1, characterized in that the minimum distance between two adjacent support structures in a region of the coolant jacket corresponds at least to half the cylinder head screw diameter.

3. The cylinder housing of claim 2, wherein the minimum distance between two adjacent support structures in the region of the coolant jacket corresponds to at least to the cylinder head screw diameter.

4. The cylinder housing of claim 2, characterized in that at least one screw receptacle is spaced from the deck.

5. The cylinder housing according to claim 1, characterized in that at least one screw receptacle is spaced from the closed deck.

6. The cylinder housing of claim 5, characterized in that at least one screw receptacle is arranged in a central region of the cylinder.

7. The cylinder housing according to claim 1, characterized in that at least one screw receptacle is arranged in a central region of the cylinder.

8. The cylinder housing of claim 7, characterized in that at least one screw receptacle is arranged in a central third of the cylinder.

9. The cylinder housing of claim 7, characterized in that at least one screw receptacle borders laterally on support structures of two adjacent cylinders.

10. The cylinder housing of claim 7, Characterized in that the support structure is formed hollow-cylindrical in the region of the coolant jacket.

11. The cylinder housing according to claim 1, characterized in that the support structure is a hollow-cylinder in a region of the coolant jacket.

12. The cylinder housing according to claim 1, characterized in that the support structures, in a region of a base of a conically shaped transition region, are connected to one another via an intermediate deck.

13. The cylinder housing according to claim 12, characterized in that the intermediate deck is connected to a main bearing wall.

14. The cylinder housing according to claim 1, characterized in that the coolant jacket is formed between a cylindrical inner wall of the support structure and a cylindrical outer wall of the cylinder liner.

15. The cylinder housing of claim 14, characterized in that the coolant jacket is formed in an upper third of the cylinder.

16. The cylinder housing according to claim 1, further includes a main bearing wall formed integrally with the cylinder housing, the main bearing wall is arranged between the at least two adjacently arranged cylinders in the region of the at least one engine transverse plane.

17. The cylinder housing of claim 16, characterized in that, when installed within an internal combustion engine and during, operation of the internal combustion engine, the support structure is configured and arranged to be subjected to compressive forces in a region formed between the cylinder head sealing surface and the screw receptacle, and the remaining region of the support structure and the main bearing walls are configured and arranged to be subjected to tensile forces.

18. The cylinder housing of claim 1, characterized in that, in the installed state during operation of the internal combustion engine, the support structure is configured and arranged to be subjected to compressive forces in a region formed between the cylinder head sealing surface and the screw receptacle, and the remaining region of the support structure and the main bearing walls are configured and arranged to be subjected to tensile forces.

19. The cylinder housing of claim 1, characterized in that the support structure, in a region of the screw receptacle and in the direction of the crankcase, has a conically shaped transition region.

* * * * *